US007331820B2

(12) United States Patent
Burris et al.

(10) Patent No.: US 7,331,820 B2
(45) Date of Patent: Feb. 19, 2008

(54) CHEMICALLY ATTACHED COAXIAL CONNECTOR

(75) Inventors: Donald A. Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/230,437

(22) Filed: Sep. 19, 2005

(65) Prior Publication Data

US 2007/0066134 A1 Mar. 22, 2007

(51) Int. Cl.
*H01R 9/05* (2006.01)

(52) U.S. Cl. ..... 439/578; 439/275; 439/874; 439/936

(58) Field of Classification Search ..... 439/578, 439/587, 589, 271, 275, 874, 583–585, 276, 439/936

See application file for complete search history.

(56) References Cited

U.S. PATENT DOCUMENTS

| | | | | | |
|---|---|---|---|---|---|
| 2,540,012 | A | | 1/1951 | Salati | 178/44 |
| 3,083,260 | A | | 3/1963 | Bird | 174/87 |
| 3,104,145 | A | | 9/1963 | Somerset | 339/103 |
| 3,385,922 | A | | 5/1968 | Rice | 174/84 |
| 3,492,408 | A | | 1/1970 | Forney, Jr. et al. | 174/75 |
| 3,538,487 | A | | 11/1970 | Lanham, Jr. | 339/95 |
| 3,550,064 | A | * | 12/1970 | Caller et al. | 439/276 |
| 3,634,815 | A | | 1/1972 | Stevens et al. | 339/177 |
| 3,745,232 | A | | 7/1973 | Johnson et al. | 174/107 |
| 3,764,959 | A | | 10/1973 | Toma et al. | 339/177 |
| 4,091,233 | A | | 5/1978 | Berman | 174/88 |
| 4,144,404 | A | | 3/1979 | De Groef et al. | 174/88 |
| 4,176,244 | A | | 11/1979 | Ramy et al. | 174/88 |
| 4,305,638 | A | | 12/1981 | Hutter | 339/177 |
| 4,540,231 | A | * | 9/1985 | Forney, Jr. | 439/306 |
| 4,755,152 | A | * | 7/1988 | Elliot et al. | 439/452 |
| 5,315,066 | A | | 5/1994 | Spiteri, Sr. | 174/87 |
| 5,340,332 | A | | 8/1994 | Nakajima et al. | 439/584 |
| 5,418,876 | A | | 5/1995 | Lee | 385/80 |
| 5,435,751 | A | | 7/1995 | Papenheim et al. | 439/589 |
| 5,561,900 | A | | 10/1996 | Hosler, Sr. | 29/828 |
| 5,941,736 | A | * | 8/1999 | Murakami | 439/733.1 |
| 6,461,169 | B1 | | 10/2002 | Harrison et al. | 439/65 |
| 6,878,880 | B2 | | 4/2005 | King, Jr. | 174/87 |

OTHER PUBLICATIONS http://www.threebond.co.jp/en/index.html \ Product Information \Silicone adhesive sealants for electric and electronic equipment.*

* cited by examiner

*Primary Examiner*—Renee Luebke
*Assistant Examiner*—Vanessa Girardi
(74) *Attorney, Agent, or Firm*—Joseph M. Homa; Matthew J. Mason

(57) ABSTRACT

A coaxial connector for attaching the end of a coaxial cable to an equipment port includes a tubular post, a coupler, a body member having a cylindrical sleeve, and one or more reservoirs containing a chemical component disposed between the post and the cylindrical sleeve. Insertion of the coaxial cable into the connector opens the reservoir, releases the chemical component, and secures the jacket of the cable within the cylindrical sleeve. The chemical component(s) can include an adhesive, a volume-expanding material, and/or an agent that swells the jacket of the cable. Two or more chemical components may be stored in two or more adjacent reservoirs.

29 Claims, 8 Drawing Sheets

CHEMICALLY ATTACHED COAXIAL CONNECTOR

BACKGROUND OF INVENTION

1. Field of the Invention

The present invention relates generally to coaxial cable connectors used to connect the ends of coaxial cables to mating ports, and more particularly, to coaxial cable connectors capable of being installed upon the ends of coaxial cables without the need for crimp tools, compression tools, or the like.

2. Technical Background

Coaxial cable connectors such as F-connectors, RCA connectors, and BNC connectors are often used to attach the ends of coaxial cables to another object such as an appliance or junction having a coaxial terminal port adapted to engage such connector. Different coaxial connectors require different types of installation tools for use in the field when securing such connectors onto the prepared end of a coaxial cable. For example, one style of coaxial connector, known as a crimp connector, requires the use of a crimping tool to radially compress the body of the connector over the end of the coaxial cable in order to reliably secure the connector to the end of the cable. Another style of coaxial connector, known as an axial compression connector, requires the use of an axial compression tool to axially compress the connector to reliably secure the connector to the end of the cable. The need to carry such installation tools imposes a burden upon field technicians responsible for installing such connectors. Moreover, it takes time and experience for field technicians to master the proper use of such installation tools to correctly install such connectors on the end of a coaxial cable. A field technician lacking such experience is likely to install such connectors incorrectly, leading to signal degradation and customer complaints.

Coaxial connectors are often installed outdoors where they are exposed to the elements. Entry of moisture inside such connectors typically degrades the electrical signal path, and interferes with reception of the transmitted signal. Moisture may also lead to leakage of the transmitted signal. Accordingly, manufacturers of coaxial connectors to be used outdoors, or in other invasive environments, strive to ensure that such coaxial connectors form a moisture-proof seal that prevents moisture ingress after such connectors are installed upon the end of a coaxial cable.

There are a variety of cable sizes and conductive sheath braid thicknesses in use within cable transmission systems. While coaxial connector manufacturers have, from time to time, attempted to produce a so-called "universal" coaxial connector capable of being used with a variety of cable sizes and types, it is still the case that field technicians must carry an inventory of several different types of coaxial connectors to cover the entire range of cable sizes and types that they are likely to encounter.

Accordingly, it is an object of the present invention to provide a coaxial connector for connecting the end of a coaxial cable to a mating coaxial port which is capable of being reliably installed onto the end of a coaxial cable without the need for crimp tools, compression tools, or similar installation tools.

Another object of the present invention is to provide such a coaxial connector that reduces the risk of moisture ingress and signal egress at the point where the coaxial connector is secured over the end of the coaxial cable.

Still another object of the present invention is to provide a coaxial connector that is more "installer friendly", and which reduces craft sensitivity by utilizing a method of attachment that avoids the need for the use of special activation tools.

A further object of the present invention is to provide such a coaxial connector that may be used with a broad range of cable sizes and cable types, thereby reducing the number of connector types that must be carried by a field technician.

A still further object of the present invention is to provide such a coaxial connector which, upon being installed onto the end of a coaxial cable, helps to prevent moisture ingress and signal egress from the end of the cable.

These and other objects of the present invention will become more apparent to those skilled in the art as the description of the present invention proceeds.

SUMMARY OF THE INVENTION

Briefly described, and in accordance with preferred embodiments thereof, the present invention relates to a coaxial connector for coupling the end of a coaxial cable to a coaxial port, and including a tubular post, a coupler, a cylindrical body member, and one or more reservoirs of one or more chemical components. A first end of the tubular post is adapted to be inserted into an exposed end of the coaxial cable around the dielectric thereof, just under the conductive grounding sheath of the coaxial cable. The coupler preferably rotatably engages the opposing second end of the tubular post and is used to secure the connector to a coaxial port. The cylindrical body member is secured to the second end of the tubular post and includes a cylindrical sleeve extending about the first end of the tubular post and having an open end for receiving a prepared end of the coaxial cable. In addition, a reservoir containing a chemical component is disposed within the cylindrical body member between the tubular post and the inner wall of said cylindrical sleeve, wherein the insertion of the prepared end of the coaxial cable into the connector releases the chemical component from the reservoir for securing the protective outer jacket of the coaxial cable within the cylindrical sleeve of the connector.

In a first preferred embodiment, the chemical component is an adhesive component. Insertion of the prepared end of the coaxial cable into the connector releases the adhesive component from the reservoir. The adhesive is worked between the protective outer jacket of the cable and the inner wall of the cylindrical sleeve for effecting an adhesive bond therebetween. It is preferred, though not necessary, that such adhesive be a two-component adhesive, such as a resin and an activating catalyst. Accordingly, first and second reservoirs, containing first and second adhesive components, may be disposed, generally proximate to each other, within the cylindrical body member between the tubular post and the inner wall of the cylindrical sleeve; insertion of the prepared end of the coaxial cable into the connector releases both of the first and second adhesive components from their respective reservoirs, allowing the two adhesive components to mix and chemically react with each other, thereby effecting an adhesive bond between the protective outer jacket of the coaxial cable and the inner wall of the cylindrical sleeve.

In a second preferred embodiment, the chemical component is a volume-expanding component that initially occupies a relatively small volume before being released from its reservoir. Insertion of the prepared end of the coaxial cable into the connector releases this chemical component from its reservoir, and upon such release, the chemical component significantly increases in volume for substantially filling at least a portion of the space lying between the protective outer jacket of the coaxial cable and the inner wall of said cylindrical sleeve. Once again, the volume-expanding chemical component may be initially provided as first and second separate chemical components within first and second adjacent reservoirs, respectively. Both the first and second chemical components initially occupy a relatively small volume before being released. Insertion of the prepared end of the coaxial cable into the connector releases both the first and second chemical components from their respective reservoirs, allowing the first and second chemical components to mix and chemically react with each other. The resulting chemical reaction produces filler material of significantly greater volume for substantially filling at least a portion of the space lying between the protective outer jacket of the coaxial cable and the inner wall of said cylindrical sleeve, thereby locking the end of the cable within the connector, and preventing moisture from entering into the open end of the cylindrical body.

In a third preferred embodiment, the chemical component is one which chemically reacts with the outer protective jacket of the coaxial cable, causing such protective jacket to swell inside the connector. A reservoir containing the chemical component is disposed within the cylindrical body member between the tubular post and the inner wall of the cylindrical sleeve. Upon being released from the reservoir as a result of the insertion of the prepared end of the cable, the chemical component spreads over, contacts, and chemically reacts with, the protective outer jacket of the coaxial cable to cause it to swell within, and substantially fill, at least a portion of the space lying between the conductive grounding sheath of the coaxial cable and the inner wall of said cylindrical sleeve.

If desired, the chemical component(s) mentioned above may be provided in micro-encapsulated form to facilitate storage of such chemical components within the connector until activated by insertion by the prepared end of the cable.

In each of the preferred embodiments summarized above, the inner wall of the cylindrical sleeve may include at least one annular ring formed therein to aid in engaging the adhesive, the volume-expanding material, or the swelled portion of the outer protective jacket of the coaxial cable. Alternately, or in addition thereto, the inner wall of the cylindrical sleeve may include an inwardly-directed flange proximate the open end thereof to aid in engaging and retaining engaging the adhesive, the volume-expanding material, or the swelled portion of the outer protective jacket of the coaxial cable.

DESCRIPTION OF THE PREFERRED EMBODIMENTS

Figure 1:
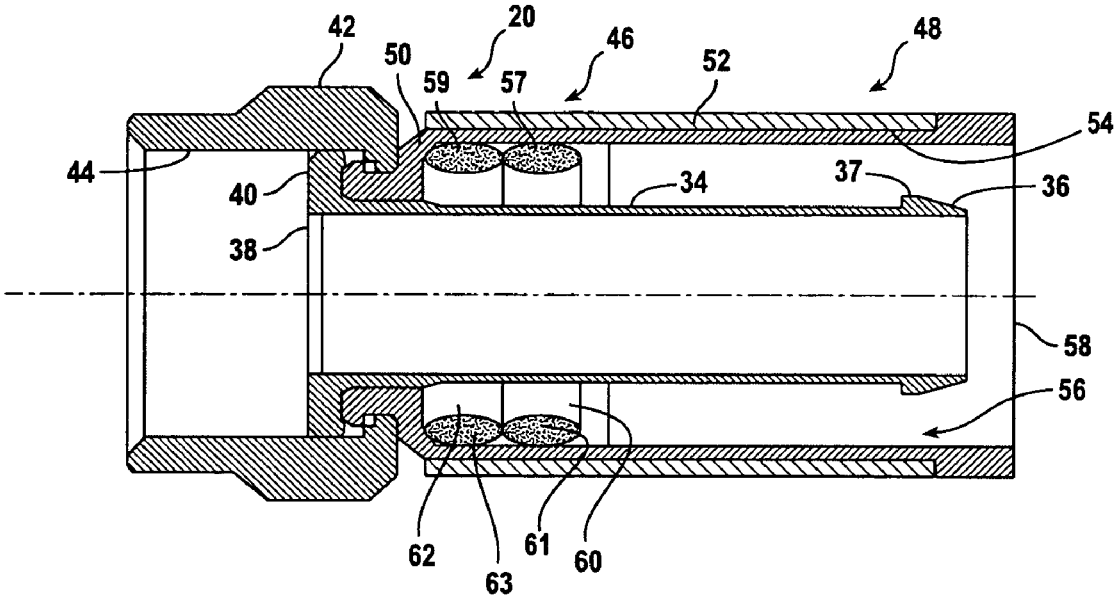
FIG. 1 is a sectional view of a coaxial connector according to a first preferred embodiment of the present invention including a two-component chemical system, and prior to insertion of the prepared end of a coaxial cable.

In a first set aspect, a coaxial connector is disclosed herein for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination: a tubular post having a first end adapted to be inserted into an end of the coaxial cable around the dielectric thereof and under the conductive grounding sheath thereof, said tubular post having an opposing second end; a coupler engaging the second end of said tubular post, the coupler serving to secure the connector to the coaxial port; a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and a first reservoir containing a first adhesive component, the first reservoir being disposed within the cylindrical body member between the tubular post and the inner wall of said cylindrical sleeve, wherein the insertion of the end of the coaxial cable into the connector releases said first adhesive component from the first reservoir for effecting an adhesive bond between the protective outer jacket of the coaxial cable and the inner wall of said cylindrical sleeve.

In some of the embodiments of the first aspect, the coaxial connector further comprises a second reservoir containing a second adhesive component disposed within the cylindrical body member between the tubular post and the inner wall of said cylindrical sleeve, and generally proximate to said first reservoir, wherein the insertion of the end of the coaxial cable into the connector releases both said first and second adhesive components from the first and second reservoirs, respectively, for effecting an adhesive bond between the protective outer jacket of the coaxial cable and the inner wall of said cylindrical sleeve. In some embodiments, said first and second adhesive components chemically react with each other upon contact with each other.

In some embodiments of the first aspect, the inner wall of said cylindrical sleeve comprises at least one annular ring formed therein to aid in forming a bond with said first adhesive component.

In some embodiments of the first aspect, the inner wall of said cylindrical sleeve includes an inwardly-directed flange proximate the open end thereof to help prevent leakage of said first adhesive component out of said cylindrical sleeve.

In some embodiments of the first aspect, said first adhesive component is contained in microcapsules, and the microcapsules are disposed within the reservoir.

In a second aspect, a coaxial connector is disclosed herein for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination: a tubular post having a first end adapted to be inserted into an end of the coaxial cable around the dielectric thereof and under the conductive grounding sheath thereof, said tubular post having an opposing second end; a coupler engaging the second end of said tubular post, the coupler serving to secure the connector to the coaxial port; a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and a first reservoir containing a first chemical component disposed within the cylindrical body member between the tubular post and the inner wall of said cylindrical sleeve, said first chemical component occupying a first initial volume before being released from the first reservoir, wherein the insertion of the end of the coaxial cable into the connector releases said first chemical component from the first reservoir, the first chemical component increasing in volume, relative to the first initial volume, upon release from the first reservoir for substantially filling at least a portion of a space lying between the protective outer jacket of the coaxial cable and the inner wall of said cylindrical sleeve.

In some embodiments of the second aspect, the coaxial connector further comprises a second reservoir containing a second chemical component disposed within the cylindrical body member between the tubular post and the inner wall of said cylindrical sleeve, and generally proximate to said first reservoir, said second chemical component occupying a second initial volume before being released from the second reservoir, wherein the insertion of the prepared end of the coaxial cable into the connector releases both said first and second chemical components from the first and second reservoirs, respectively, the first and second chemical components increasing in volume, relative to their respective initial volumes, upon release from their respective reservoirs for substantially filling at least a portion of the space lying between the protective outer jacket of the coaxial cable and the inner wall of said cylindrical sleeve. In some embodiments, said first and second chemical components chemically react with each other upon contact with each other.

In some embodiments of the second aspect, the inner wall of said cylindrical sleeve includes at least one annular ring formed therein to aid in engaging the expanded volume of said first chemical component following its release from said first reservoir.

In some embodiments of the second aspect, the inner wall of said cylindrical sleeve includes an inwardly-directed flange proximate the open end thereof to help prevent leakage of the expanded volume of said first chemical component out of said cylindrical sleeve following its release from said first reservoir.

In some embodiments of the second aspect, said first chemical component is in the form of microcapsules, and the microcapsules are disposed within the reservoir.

In a third aspect, a coaxial connector is disclosed herein for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination: a tubular post having a first end adapted to be inserted into an end of the coaxial cable around the dielectric thereof and under the conductive grounding sheath thereof, said tubular post having an opposing second end; a coupler engaging the second end of said tubular post, the coupler serving to secure the connector to the coaxial port; a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and a reservoir containing a chemical component disposed within the cylindrical body member between the tubular post and the inner wall of said cylindrical sleeve, said chemical component reacting with the protective outer jacket of the coaxial cable upon contact therewith for causing swelling of said protective outer jacket, wherein the insertion of the end of the coaxial cable into the connector releases said chemical component from the reservoir for making contact with the outer protective jacket of the coaxial cable, and for causing the outer protective jacket to swell within, and substantially fill, at least a portion of a space lying between the conductive grounding sheath of the coaxial cable and the inner wall of said cylindrical sleeve. In some embodiments, the inner wall of said cylindrical sleeve includes at least one annular ring formed therein to aid in engaging the swelled portion of the outer protective jacket of the coaxial cable.

In some embodiments of the third aspect, the inner wall of said cylindrical sleeve includes an inwardly-directed flange proximate the open end thereof to aid in engaging the swelled portion of the outer protective jacket of the coaxial cable.

In some embodiments of the third aspect, said chemical component is in the form of microcapsules, and the microcapsules are disposed within the reservoir.

In a fourth aspect, a method is disclosed herein of securing an end of a coaxial cable within a coaxial connector, the coaxial cable including a center conductor surrounded by a dielectric, a conductive grounding sheath, and an outer protective cable jacket, comprising the steps of: providing a coaxial connector including a tubular post, a body having a cylindrical sleeve surrounding the tubular post and having an open end for receiving the end of the coaxial cable, and including a coupler for securing the coaxial connector to a coaxial port; inserting into the coaxial connector, between the tubular post and the cylindrical sleeve, at least one chemical agent stored within a frangible reservoir, said insertion step being performed before supplying such coaxial connector to an end user; inserting the end of the coaxial cable into the open end of the cylindrical sleeve of the connector body, opening the frangible reservoir, and releasing the at least one chemical agent to flow within the annulus formed between the tubular post and the cylindrical sleeve to secure the coaxial cable within the cylindrical sleeve of the connector. In some embodiments, these steps are performed sequentially in the order recited above. In other embodiments, these steps are performed in a different order, for example the frangible reservoir may be opened and the at least chemical agent may flow within the annulus before the cable is inserted into the open end of the cylindrical sleeve of the connector body.

In some embodiments of the fourth aspect, the chemical agent is an adhesive.

In some embodiments of the fourth aspect, the chemical agent includes two adhesive components stored in two frangible reservoirs, and said insertion step includes the step of opening both frangible reservoirs as a result of inserting the end of the coaxial cable to mix the two adhesive components.

In some embodiments of the fourth aspect, the chemical agent is an expandable sealant.

In some embodiments of the fourth aspect, the chemical agent includes two expandable sealant components stored in two frangible reservoirs, and said insertion step includes the step of opening both frangible reservoirs as a result of inserting the end of the coaxial cable to mix the two expandable sealant components.

In some embodiments of the fourth aspect, the chemical agent causes the protective outer jacket of the coaxial cable to swell upon contact therewith.

In some embodiments of the fourth aspect, the method further comprises securing the protective outer jacket of the coaxial cable within the cylindrical sleeve of the connector as a result of the release of such chemical agent.

In some embodiments of the fourth aspect, the method further comprises curing the released chemical agent.

In a fifth aspect, a coaxial connector is disclosed herein for connection to a coaxial cable, the coaxial connector comprising: a cylindrical body comprising an inner wall bounding a central bore; a tubular member disposed within the central bore and comprising an outer wall, wherein the outer wall and the inner wall of the cylindrical body define an annular space; and a rupturable body disposed within the annular space, the rupturable body containing a flowable material; wherein the cylindrical body, the tubular member, and the rupturable body are adapted to allow the rupturable body to rupture upon insertion of the cable within the annular space and to allow the flowable material to contact the coaxial cable.

In some embodiments of the fifth aspect, the flowable material is a liquid. In some embodiments, the liquid is an adhesive. In some embodiments, the adhesive cures into solid form. In some embodiments, the liquid has a first volume within the rupturable body, and wherein the liquid cures into a solid after escaping from the rupturable body, the solid having a second volume greater than said first volume. In some embodiments, the liquid, upon escaping from the rupturable body, causes a portion of the cable to swell.

In some embodiments of the fifth aspect, the cylindrical body includes radial compression ridges adapted to be crimped radially inwardly sufficient to grip the coaxial cable.

In some embodiments of the fifth aspect, the coaxial connector further comprises a compression member adapted to be axially compressed together with the cylindrical body to grip the coaxial cable.

In some embodiments of the fifth aspect, the flowable material is contained entirely within the rupturable body, without directly contacting the cylindrical body or tubular member, until the rupturable body is ruptured.

Other aspects and embodiments of the present invention are also contemplated and are not limited to the above.

Figure 2:
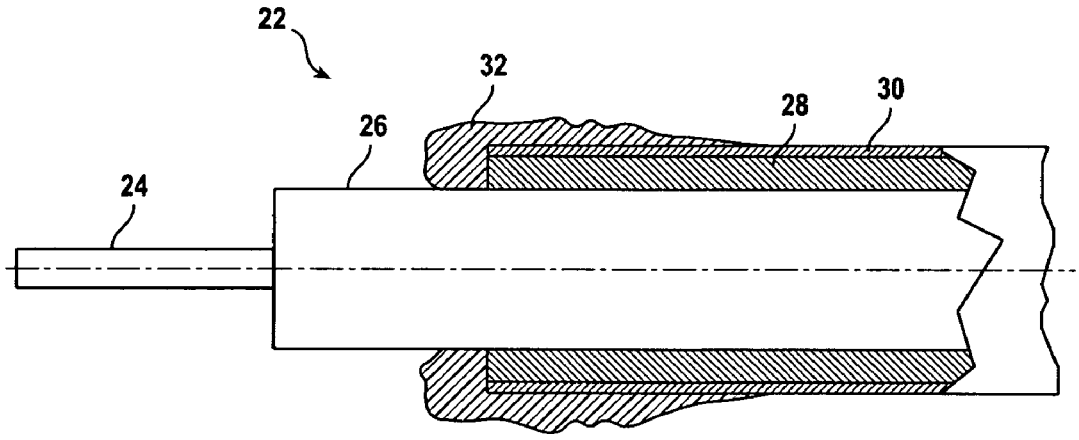
FIG. 2 is a sectional view of the prepared end of the coaxial cable to be installed within the connector of FIG. 1.
Figure 8:
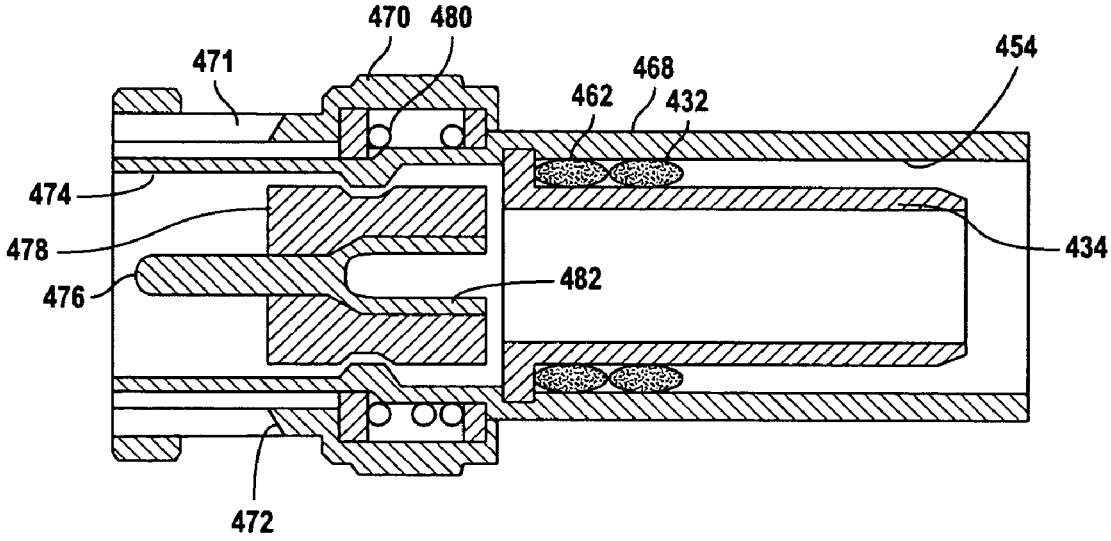
FIG. 8 is a sectional view of a preferred embodiment of the present invention in the form of a BNC-style coaxial connector.
Figure 9:
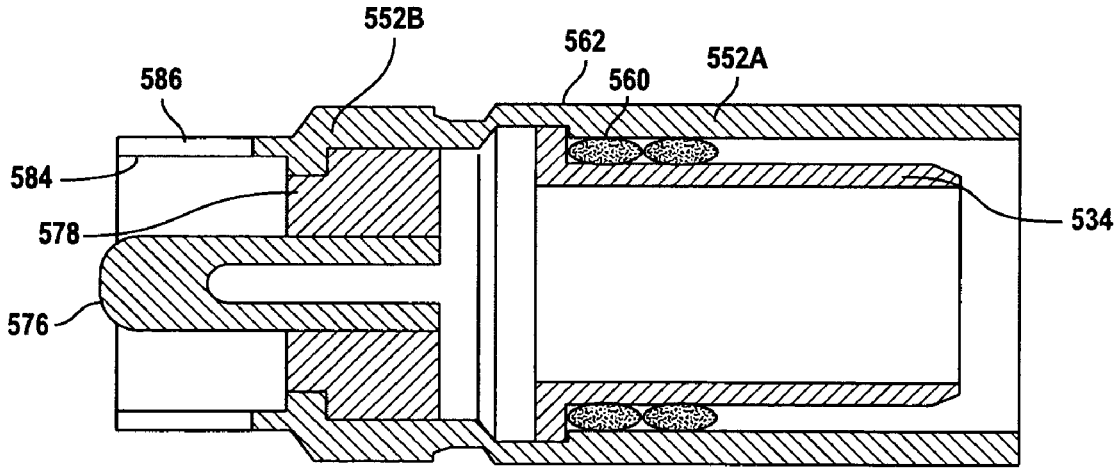
FIG. 9 is a sectional view of a preferred embodiment of the present invention in the form of an RCA-style coaxial connector.

Within FIG. 1, a coaxial connector constructed in accordance with a first preferred embodiment of the present invention is designated generally by reference numeral 20. Coaxial connector 20 serves the purpose of coupling the end of a coaxial cable (such as shown in FIG. 2) to a coaxial equipment port, for example, a threaded female coaxial CATV port extending from a television set. While coaxial connector 20 is illustrated as an F-style connector, other embodiments of the present invention include BNC-style connectors and RCA-style connectors, as shown in FIGS. 8 and 9, respectively, described below.

Referring briefly to FIG. 2, coaxial cable 22 includes a center conductor 24 surrounded by a dielectric material 26. In turn, dielectric material 26 is surrounded by a conductive, metallic grounding sheath, or braid, 28, which serves as an outer conductor. For some varieties of coaxial cable, a thin metal foil (not shown) is bonded to the outer wall of dielectric material 26, within grounding sheath 28; the aforementioned metal foil functions as an outer conductor. Grounding sheath 28 is likewise surrounded by a protective outer jacket 30 that is typically formed from polyvinylchloride (PVC) material. In FIG. 2, the end of coaxial cable 22 has been "prepared" for insertion into a coaxial connector. The end portion of protective jacket 30 has been stripped away to expose the end portion of grounding sheath 28, and the exposed portion 32 of grounding sheath 28 is folded back over the end of jacket 30. An end portion of dielectric material 26 has also been stripped from the end of coaxial cable 22 to expose the tip of center conductor 24.

Returning to FIG. 1, coaxial connector 20 includes a tubular post 34 having a first end 36 adapted to be inserted into the prepared end of coaxial cable 22 around the dielectric material 26, and under the conductive grounding sheath 28 of cable 22. Tubular post 34 also has an opposing second end 38 having an enlarged shoulder 40 extending therefrom. Coaxial connector 20 further includes a coupler, one example of which is shown in the form of coupling nut 42, rotatably engaged over shoulder 40 at second end 38 of tubular post 34. Inner wall portion 44 of coupling nut 42 may be threaded for securing connector 20 to a coaxial equipment port in a manner well known to those skilled in the art.

Coaxial connector 20 also includes a cylindrical body member 46 having a first end 48 and an opposing second end 50. First end 48 of body 46 is in the form of a cylindrical sleeve 52 having an inner wall 54 bounding a central bore 56 which extends about tubular post 34. Cylindrical sleeve 52 has an open end 58 for receiving the prepared end of coaxial cable 22 (see FIG. 2). In some preferred embodiments, second end 50 of body 46 is joined with second end 38 of tubular post 34, as by a press fit. Coupler 42 is preferably made from Nickel-plated brass, and tubular post 34 is preferably made from Tin-plated brass. Body 46 may be made from plastic or metal. If, for example, body 46 is to be crimpable or otherwise deformable, then body 46 is preferably made from Nickel-plated brass. If body 46 is made from plastic, then the preferred plastic is Acetal plastic material, a crystalline thermoplastic polymer with a high melting point. The homopolymer form of Acetal resin is commercially available under the registered trademark DELRIN® from E. I. duPont de Nemours & Co. of Wilmington, Del. and its distributors.

Still referring to FIG. 1, a first reservoir 60 is disposed within the annulus of central bore 56 formed between the outer wall of tubular post 34 and inner wall 54 of cylindrical sleeve 52. First reservoir 60 is shown in FIG. 1 as a toroidal, or doughnut, shaped container preferably encircling tubular post 34. As will be explained below in greater detail below in conjunction with FIGS. 11A-11E, reservoir 60 need not form a complete, continuous ring; reservoir 60 can alternately form a portion of a circle, a spiral-shaped structure, or other-shaped structure.

For reasons to be explained below, it may also be desired to provide a second reservoir 62, for example, of similar shape, between the outer wall of tubular post 34 and inner wall 54 of cylindrical sleeve 52, generally adjacent to first reservoir 60. Alternatively, first and second reservoirs 60 and 62 may each be provided as semi-circular half-doughnut shapes arranged to form a composite doughnut shape. Other alternatives are described in greater detail below in conjunction with FIGS. 11A-11E and 12A-12F. In any event, reservoirs 60 and 62 are stackable for positioning two or more of such reservoirs within the annulus formed between tubular post 34 and inner wall 54 of cylindrical sleeve 52. Each of such reservoirs 60 and 62 is preferably positionable within the annulus formed between tubular post 34 and inner wall 54 of cylindrical sleeve 52. Reservoirs 60 and 62 are each capable of being wound around the outer wall of tubular post 34.

Each of reservoirs 60 and 62 contains one or more chemical components 57 and 59, respectively. Preferably, these chemical components 57 and 59, as well as their resulting product of reaction, are electrically non-conductive. Electrically-conductive chemical components and/or products of reaction may be used without impairing the function of connector 20, provided that such chemical components and products of reaction are restrained within the annulus formed between tubular post 34 and inner wall 54 of cylindrical sleeve 52. Were electrically-conductive chemical components used, and were such chemical components to leak through the joint formed between body member 46 and tubular post 34, along inner wall 44 of coupling nut 42, and form a bridge to center conductor 24 of coaxial cable 22, then the transmission of a desired cable signal would be compromised. The outer lining, or casing, of reservoirs 60 and 62 is designated within FIG. 1 by reference numerals 61 and 63, respectively, and is made from a rupturable, tearable and/or frangible material that is easily pierced, broken, or torn open upon being contacted by exposed portion 32 of grounding sheath 28 upon contact therewith. Casings 61 and 63 are made as thin as possible, to facilitate tearing when exposed portion 32 of grounding sheath 28 is twisted against such casings, while being thick enough to retain the chemicals therein until the connector is installed over the end of a coaxial cable. This rupturing action is facilitated by application of a compressive force transmitted within the region bounded by body 46, post 34 and grounding sheath 38, as by axially advancing the end of coaxial cable 22 into body 46. It is preferred that the casings 61 and 63 are ruptured directly by insertion of coaxial cable 22 within connector 20, though it may be possible to insert a suitable reservoir piercing tool into connector 20 to rupture casings 61 and 63 immediately before inserting the end of coaxial cable 22 within connector 20. Casings 61 and 63 are preferably made of electrically-non-conductive material, though metal foils may be used to form casings 61 and 63 without impairing the function of connector 20.

In some embodiments, the contents of reservoirs 60 and 62 are both flowable materials. As used herein, the term "flowable materials" is intended to include liquids (e.g., pourable fluids) as well as pastes, gels and other semi-solid materials that can easily change their shape. In other cases, the contents of reservoir 60 might be a flowable material, while the contents of reservoir 62 may be in solid form (e.g., as a powder), or vice versa. If desired, the outer wall of tubular post 34 may have threads or protrusions formed thereon in the vicinity of reservoirs 60 and 62 to aid in mixing the released chemical components as cable 22 is twisted within connector 20 during installation. If the contents of reservoirs 60 and 62 are adhesive components or volume-expanding components, then reservoirs 60 and 62 are preferably made from thin-walled polystyrene plastic film.

Figure 3:
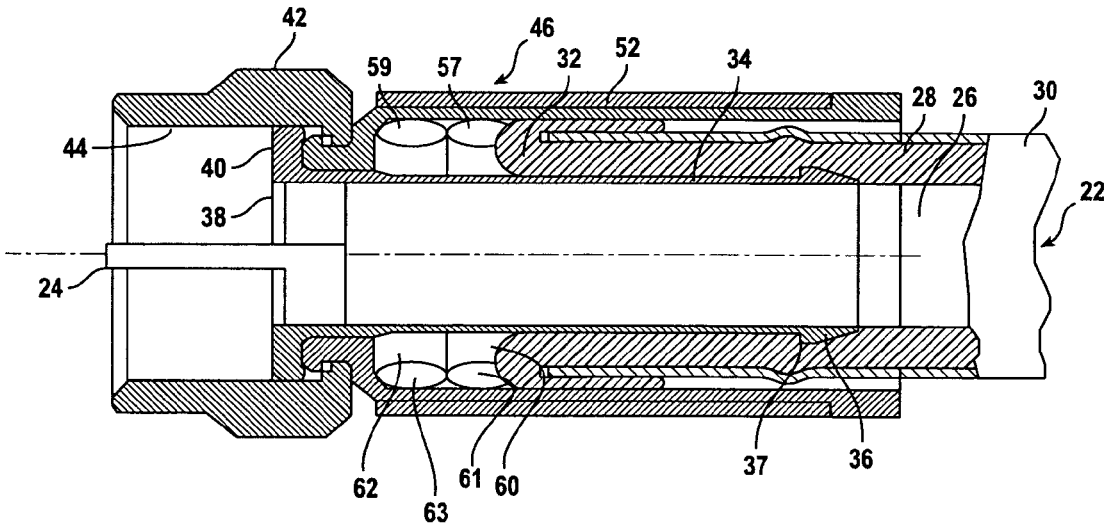
FIG. 3 is a sectional view of the connector of FIG. 1 and the prepared end of the cable of FIG. 2 just as the end of the cable is being inserted into the connector, and just prior to fracture of the chemical component reservoir(s).

Turning now to FIG. 3, the prepared end of coaxial cable 22 has been partially inserted into inner bore 56 of cylindrical sleeve 52. First end 36 of tubular post 34 has a tapered barb 37 formed thereon for passing over dielectric material 26 (and optionally over the thin metal foil layer bonded to the outer wall of dielectric material 26), and under grounding sheath 28. The barb 37 helps to prevent disengagement of cable 22 from coaxial connector 20. In the view shown in FIG. 3, cable 22 has been inserted just to the point of bringing exposed portion 32 of grounding sheath 28 adjacent to first reservoir 60 but not yet close enough to rupture first reservoir 60. In the preferred embodiments, reservoirs 60 and 62 are provided in the form of rupturable sacs each having a length of at least one-sixteenth of an inch.

In one preferred embodiment of the present invention, reservoir 60 contains an adhesive useful in securing the end of cable 22 within connector 20. This adhesive may be a single-component adhesive, if desired. For example, the contents of reservoir 60 may be ethyl cyanoacrylate, the fast drying adhesive sold under the registered trademark "Instant Krazy Glue". Alternatively, reservoir 60 may contain a first adhesive chemical while reservoir 62 contains a second adhesive chemical, wherein the two adhesive chemicals collectively constitute a two-component adhesive, for example, an adhesive resin and an activating catalyst. As the contents of reservoirs 60 and 62 mix together, they produce a chemical reaction which activates adhesion.

Figure 4:
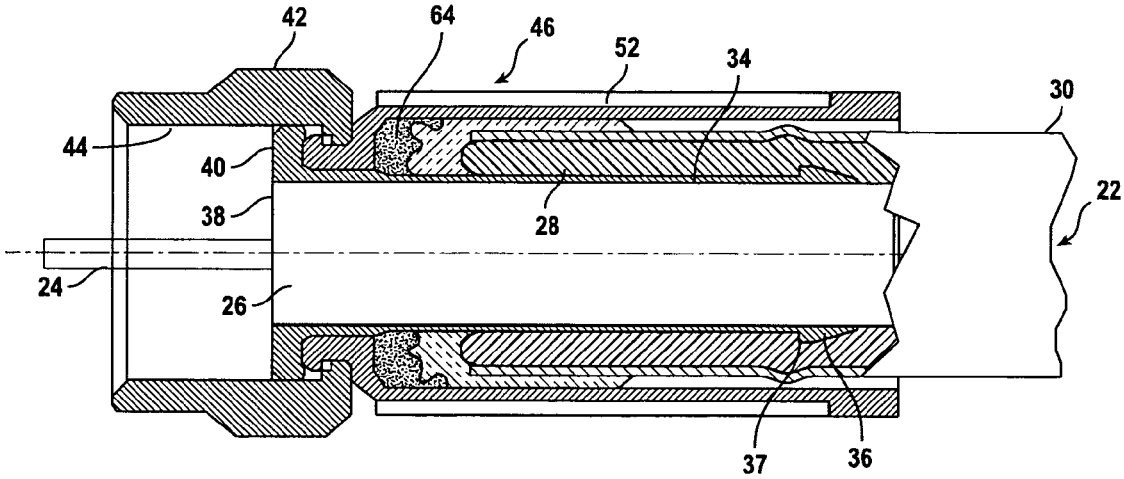
FIG. 4 is a sectional view of the fully-installed connector and cable shown in FIGS. 1-3.

With reference to FIG. 4, cable 22 is fully inserted, and preferably twisted for one-half turn; this action allows grounding sheath 38 to rupture reservoir 60; if reservoir 62 is also present, the insertion and twisting of cable 22 into connector 20 ruptures reservoir 62, as well. As shown in FIG. 4, the released adhesive 64 spreads over protective jacket 30 of cable 22 and, upon curing, firmly bonds protective jacket 30 to inner wall 54 of cylindrical sleeve 52. The adhesive may be of the epoxy or acrylic type disclosed in U.S. Pat. No. 5,941,736 to Murakami, the disclosure of which is hereby incorporated by reference. Such adhesive may, if desired, be provided in the form of microcapsules, as disclosed within the aforementioned U.S. Pat. No. 5,941,736.

In one embodiment, reservoir 60 contains the microencapsulated fluid called dicyclopentadiene, or DCPD, encapsulated in tiny bubbles within reservoir 60. In order to polymerize, the DCPD must come into contact with a catalyst. One such catalyst is called Grubbs' catalyst, a ruthenium-based catalyst discovered in the laboratories of Professor Robert Grubbs at Caltech, and commercially available from Sigma-Aldrich Corp. of St. Louis, Mo. This catalyst may be provided within reservoir 62. As reservoir 60 is ruptured, the microcapsules containing the DCPD are also ruptured and come into contact with the Grubbs' catalyst, which initiates the polymerization process. Alternatively, the adhesive components contained within reservoirs 60 and 62 may be one of the two-component epoxy adhesives available from Epic Resins of Palmyra, Wis. As another example, the adhesive component(s) may be of the type commercially available from ND Industries, Inc., headquartered in Troy, Mich., under the product name ND Microspheres® 294, a micro-encapsulated epoxy product. It is preferred that the mixed adhesive material 64 (see FIG. 4) have sealing characteristics, and that it forms a continuous 360 degree seal between inner wall 54 of cylindrical sleeve 52, cable jacket 30, and exposed regions of the outer wall of tubular post 34 near second end 38 thereof. While only two reservoirs, 60 and 62, are shown, three or more adjacent reservoirs may be used, if desired, in order to maintain three chemical components separated from each other until the end of cable is inserted into connector 20. If desired, reservoirs 60 and 62 can be secured against movement within the annular space formed between cylindrical sleeve 52 and tubular post 34, as by pre-coating such surfaces with a contact adhesive.

As noted above, the contents of reservoir 60 and/or reservoir 62 may be adhesive components. In another preferred embodiment, reservoir 60 contains a chemical component that occupies a first, relatively small volume initially before being released from reservoir 60. Insertion of the prepared end of coaxial cable 22 into connector 20 releases such chemical component from first reservoir 60; upon release from reservoir 60, such chemical component reacts with surrounding air and significantly increases in volume for substantially filling at least a portion of the space that lies between protective outer jacket 30 of coaxial cable 22 and inner wall 54 of cylindrical sleeve 52, as shown in FIG. 4.

In a preferred form, the above-described volume-increasing material is a two-component chemical system; a first chemical component is contained in reservoir 60, and a second chemical component is contained in reservoir 62. The second chemical component likewise occupies a relatively small initial volume before being released from second reservoir 62. Insertion of the prepared end of coaxial cable 22 into connector 20 releases both the first chemical component from reservoir 60 and the second chemical component from reservoir 62. Upon release, such first and second chemical components mix and react with each other; the material produced by such chemical reaction significantly increases in volume for substantially filling at least a portion of the annulus formed between cable jacket 30 of cable 22 and inner wall 54 of cylindrical sleeve 52. The aforementioned volume-expanding chemical components may also include adhesive and sealing characteristics to help form a bond between cable jacket 30 and cylindrical sleeve 52, and to seal out moisture. The mixed expanded-volume material 64 (see FIG. 4) preferably forms a continuous 360 degree seal between inner wall 54 of cylindrical sleeve 52, cable jacket 30, and exposed regions of the outer wall of tubular post 34 near second end 38 thereof.

Preferred chemical components for achieving the above-described volume-expanding characteristics include the polyisocyanurate two-component expanding sealant commercially available from Fomo Products, Inc. of Norton, Ohio under the registered trademark Silent Seal® NA. This product is adapted to fill small gaps and cavities, expands and seals in seconds after the two components mix, and cures within one hour. The cured sealant is resistant to heat and cold, is chemically inert, and preferably forms a seamless, continuous 360 degree seal. Similarly, in U.S. Pat. No. 6,182,868, assigned to Fomo Products, Inc., a two-component polyurethane expanding foam is disclosed having both sealing and adhesive properties. The first component includes polymeric isocyanate and fluorocarbons, while the second component provides the resin which may include polyol amine and a catalyst. Yet another two-component expanding polyurethane foam sealant that may be used is commercially available from American Industrial Supply Inc. of Burbank, Calif. under the trademark "AMER-FOAM".

An advantage of using an expanding foam sealant/adhesive is that the expanding volume of filler material 64 compresses cable jacket 30 and the conductive grounding sheath 28 therein against the outer wall of tubular post 34; the resulting compressive force not only helps to secure cable 22 within connector 20 but also helps to ensure: 1) a reliable electrical connection between grounding sheath 28 and tubular post 34; and 2) a weather-tight seal between cylindrical sleeve 52 and cable jacket 30. Nonetheless, a compressive force is not required, and mere reinforcement of cable jacket 30 by the expanding volume of filler material 64 will, in most cases, be sufficient to securely fasten cable 22 within connector 20.

Figure 5:
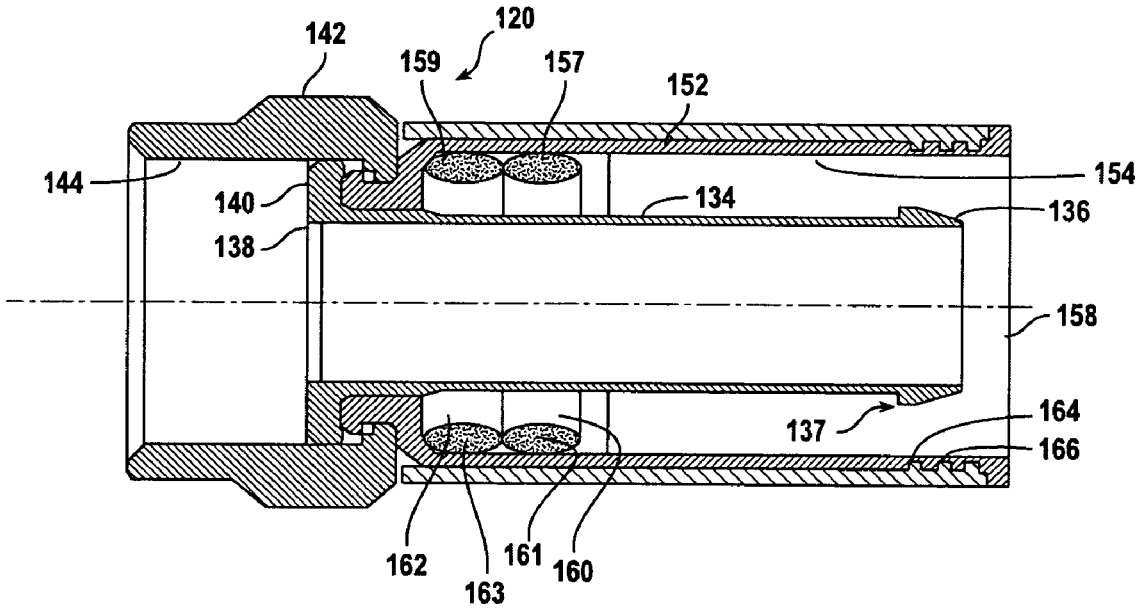
FIG. 5 is a sectional view of a second preferred embodiment of the present invention wherein a series of annular rings are formed within the inner wall of the cylindrical sleeve of the body member.

Within FIG. 5, a coaxial connector 120 is shown similar to connector 20 of FIG. 1, but connector 120 includes a cylindrical sleeve 152 having an inner wall 154 in which at least one annular ring, and preferably, a series of annular rings/ridges 164 and 166, are formed to aid in: a) forming a bond with released adhesive material; and/or b) engaging the expanded volume of filler material. If desired, the tapered surface at first end 136 of tubular post 134 may include teeth 137 formed thereupon to securely engage the conductive grounding sheath of the coaxial cable, particularly after the jacket of the cable is reinforced by the expanded volume of filler material.

Figure 6:
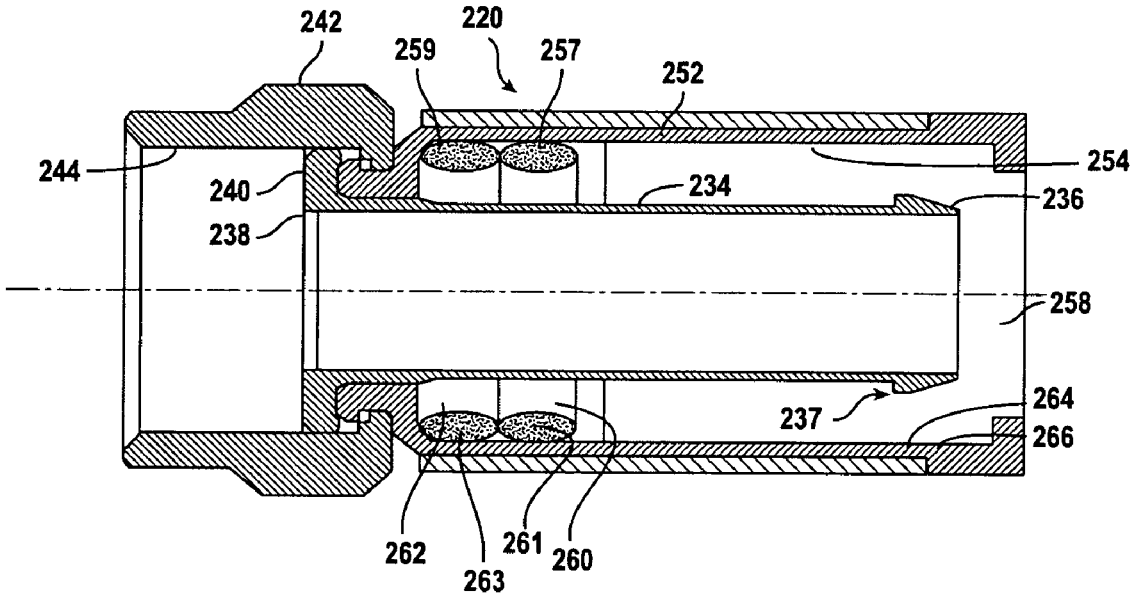
FIG. 6 is a sectional view of a third preferred embodiment of the connector of the present invention wherein the inner wall of the cylindrical sleeve of the body member includes an inwardly-directed flange at its open end.

Within FIG. 6, coaxial connector 220 is similar to connector 20 of FIG. 1, except that connector 220 includes a cylindrical sleeve 252 that includes an inwardly-directed flange 268 proximate open end 258 thereof. Flange 268 serves: a) to help prevent leakage of released adhesive components out of cylindrical sleeve 252; and/or b) to help prevent leakage of the expanded volume of filler material out of cylindrical sleeve 252.

In the examples discussed above, the chemical(s) stored in the reservoir(s) comprised adhesive components and/or expanding volume sealing components. A further preferred embodiment of the present invention instead provides a chemical component that, upon release, induces swelling of the protective outer jacket of the coaxial cable, and such swelling serves to secure the coaxial cable within the connector.

Figure 7:
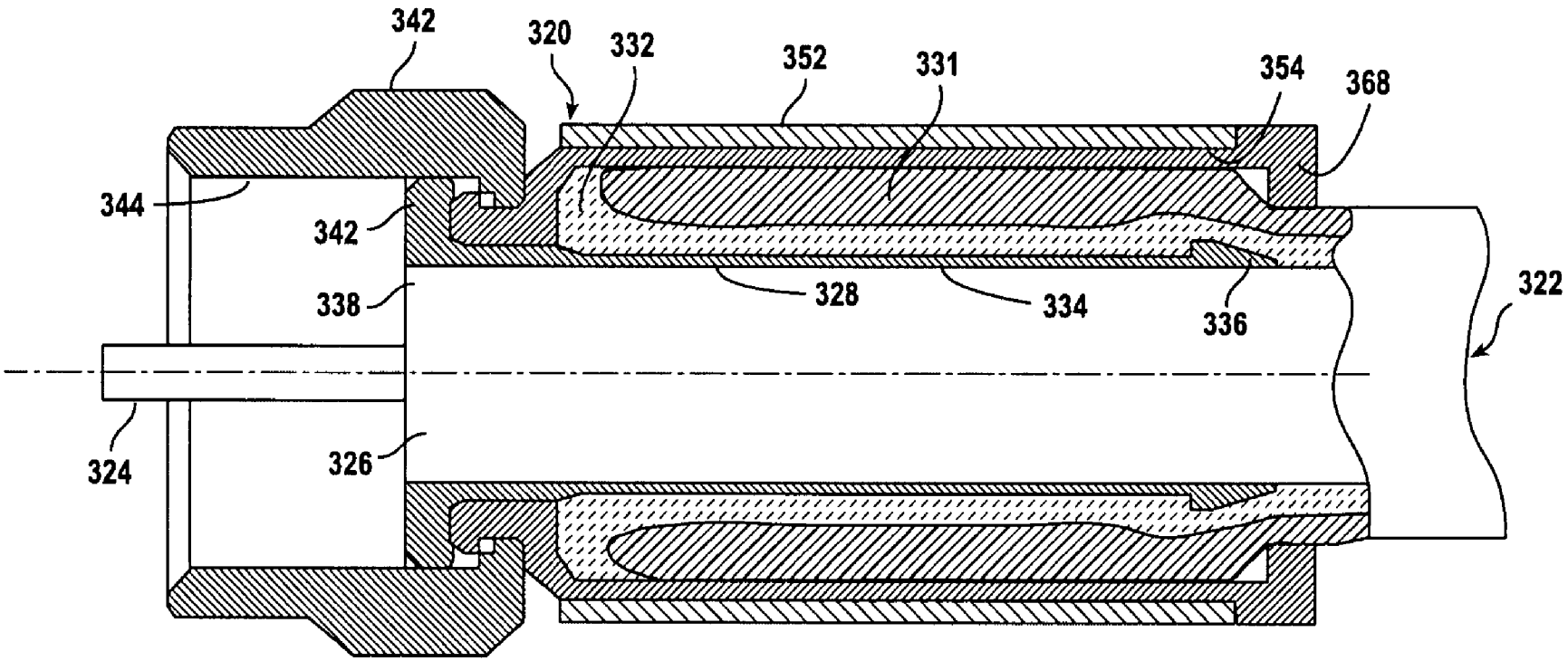
FIG. 7 is a sectional view of a preferred embodiment of the connector of the present invention fully-installed on a cable wherein the chemical component causes swelling of the protective outer jacket of the coaxial cable.

Turning to FIG. 7, coaxial connector 320 is similar to connector 220 of FIG. 6, except as to the nature of the chemical component initially stored in reservoir 60. Connector 320 of FIG. 7 stores a chemical component 257 within outer casing 261 of reservoir 260 (see FIG. 6) which, upon release from reservoir 260, and upon contact with the PVC material of cable jacket 330, causes such PVC material to swell. In this embodiment, a single-component chemical system may suffice to cause such swelling, in which case reservoir 262 (see FIG. 6) may be omitted. However, if a two-component chemical system is used to cause such PVC swelling, then reservoir 260 contains the first chemical component 257, and reservoir 262 contains the second chemical component 259. The swelled mass of PVC material, designated by reference numeral 331 in FIG. 7, preferably substantially fills the gap that originally existed between cable jacket 330 and inner wall 354 of cylindrical sleeve 352, locking coaxial cable 322 within coaxial connector 320. Preferably, swelled PVC mass 331 forms a continuous 360 degree seal between inner wall 354 of cylindrical sleeve 352, cable jacket 330, and exposed regions of the outer wall of tubular post 334 near second end 338 thereof. Inwardly-directed flange 368 both helps to retain the chemical swelling agent inside cylindrical sleeve 352 and also engages the swelled portion 331 of PVC cable jacket 330 upon swelling to securely anchor cable 322 within connector 320, and preferably forms a 360 degree continuous seal therearound.

Chemical components known to cause such swelling of PVC material include Methylethyloketone (MEK), Trichloroethylene, Tetrahydrofuran, Acetone, Dimethylformamide and Pyridine. One or more of such chemicals are maintained in a reservoir, similar to those described above as 60 and 62, between the tubular post and cylindrical sleeve 352. These PVC swelling agents may require different packaging materials, as the polystyrene plastic film mentioned above may not be compatible with certain PVC swelling agents. For Methylethyloketone (MEK), preferred packaging materials include EPDM synthetic rubber (Ethylene Propylene Diene Methylene Terpolymer), polytetrafluoroethylene (PTFE), and Chemraz® FFKM perfluoroelastomer. For Acetone and Pyridine, polypropylene, polytetrafluoroethylene (PTFE)), and Chemraz® FFKM perfluoroelastomer are preferred as packaging materials. For Dimethylformamide, polypropylene and polytetrafluoroethylene (PTFE) are preferred as packaging materials. For Trichloroethylene, polytetrafluoroethylene (PTFE) and Kalrez® perfluoroelastomer packaging is preferred. For Tetrahydrofuran, the preferred packaging materials are Chemraz® FFKM perfluoroelastomer and Kalrez® perfluoroelastomer.

Whichever of the above-described chemical agents (i.e., adhesive, volume-expanding, and/or PVC swelling) is selected, there are certain desired characteristics for such chemical agents. First, release of the chemical agent should cause limited exothermic action to prevent the connector from getting too hot, such as so hot as to burn the installer's skin. Secondly, the chemical agent and surrounding reservoir should be selected to have the ability to remain in proper place within the connector body during shipping and handling. Next, the quantity of chemical agent is preferably sufficient to expand enough to fill the voids inside the connector and effectively form a seal. The quantity, viscosity, and reactivity of the chemical agent should be selected to prevent the chemical agent from running out of the cylindrical sleeve immediately upon release before the desired engagement between the connector and coaxial cable is achieved. It is preferred that none of the chemical agent escapes the coaxial connector either during, or following, installation of the coaxial cable therein. Preferably, the released chemical agent is adapted to bond with PVC materials. Finally, when using volume-expanding sealing material, such material should be impervious to moisture after curing.

It will be appreciated that the coaxial connectors shown in FIGS. 1-7 do not require any tools, such as axial compression tools or radial crimping tools, in order to secure the end of the coaxial cable within such connectors. Likewise, such coaxial connectors do not require axial compression of any slidably-mating parts, nor radial deformation of the connector structure, in order to secure the end of the coaxial cable within such connectors. Nonetheless, it will be appreciated that the described coaxial connector structures, including their respective frangible chemical reservoir(s), could, if desired, be provided in the form of axial compression coaxial connectors, or radial-crimp coaxial connectors, as the disclosed adhesive, volume-expanding and/or cable jacket-swelling chemical component(s) will enhance the strength and/or sealing characteristics of such coaxial connectors.

FIG. 8 illustrates a preferred embodiment of the present invention in the form of a BNC-type connector. Connector body sleeve 452 surrounds a tubular post 434, and chemical reservoirs 460 and 462 are disposed therebetween in the manner described above. Each of such reservoirs 460 and 462 is preferably positionable within the annulus formed between tubular post 434 and inner wall 454 of cylindrical sleeve 452. Reservoirs 460 and 462 are each preferably capable of being wound around the outer wall of tubular post 434. Cylindrical sleeve 452 continues forward beyond post 434, terminating in a cylindrical grounding wall 474. A bayonet coupler 470 is rotatably coupled about cylindrical grounding wall 474. Bayonet coupler 470 has slots 471 and 472 formed therein to engage diametrically-opposed attachment posts extending from a conventional BNC equipment port (not shown). Dielectric 478 is supported within cylindrical grounding wall 474 for supporting a conductive center pin 476. Center pin 476 includes a central passage 482 for matingly receiving the bared end of center conductor 24 of coaxial cable 22 (see FIG. 2). Coiled spring 480 permits a degree of axial sliding movement of coupler 470 relative to cylindrical grounding wall 474. Coupler 470 can be pulled outward (i.e., to the left relative to FIG. 8) somewhat by compressing spring 480 to engage slots 471 and 472 over the aforementioned attachment posts. When an installer releases coupler 470, spring 480 biases coupler 470 back toward its original position (i.e., back toward the right relative to FIG. 8) for maintaining coupler 470 engaged with the equipment port. As in the case of the previously-described embodiments, insertion of the end of coaxial cable 22 within sleeve 452 of the connector breaks open the reservoir(s) for releasing the contents thereof to secure the cable within the connector.

FIG. 9 illustrates a preferred embodiment of the present invention in the form of an RCA-type connector. Connector body sleeve 552A surrounds a tubular post 534, and chemical reservoirs 560 and 562 are disposed therebetween in the manner described above. As described earlier, each of reservoirs 560 and 562 is preferably positionable within the annulus formed between tubular post 534 and cylindrical sleeve 552A. Reservoirs 560 and 562 are each capable of being wound around the outer wall of tubular post 534. Cylindrical sleeve 552A continues forward beyond post 534 , terminating in a cylindrical front end 552B. Front end 552B has slots 586 formed therein to engage the walls of a mating equipment port (not shown). Dielectric 578 is supported within front end 552B for supporting a conductive center plug 576. Center plug 576 includes a central passage 582 for matingly receiving the bared end of center conductor 24 of coaxial cable 22 (see FIG. 2). As in the case of the previously-described embodiments, insertion of the end of coaxial cable 22 within sleeve 552A of the connector breaks open the reservoir(s) for releasing the contents thereof to secure the cable within the connector.

Figure 10:
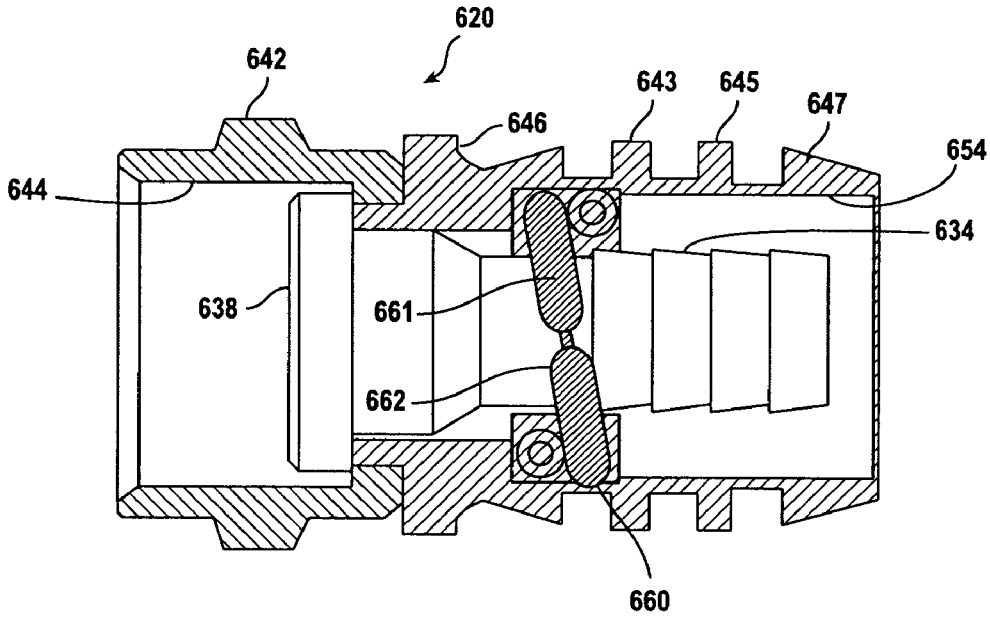
FIG. 10 is a sectional view of a preferred embodiment of the present invention in the form of a crimp-style coaxial connector.

In FIG. 10, a crimp-style F-connector 620 includes body member 646, tubular post 634, and a coupler 642. Coupler 642 is shown as a coupling nut having internal threads 644. Body member 646 includes enlarged circular ridges 643, 645 and 647 formed in its outer wall which are radially compressed by an industry-standard crimp tool after the prepared end of coaxial cable 22 is inserted into connector 620. A two-section "sausage-like" linked tubular casing 660 is disposed spirally inside connector 620 between the inner wall 654 of body 646 and tubular post 634 for containing a two-component chemical sealant. Casing 660 is preferably positionable within the annulus formed between tubular post 634 and inner wall 654 of body 646. Casing 660 is capable of being wound around the outer wall of tubular post 634. As in the case of the other examples described above, it is preferred that such two-component chemical sealant be of the volume-expanding type described above to fill any gaps and form a continuous 360 degree seal between connector 620 and the outer protective jacket of the coaxial cable inserted therein. Casing 660 is divided into two separate sections 661 and 662 forming two respective reservoirs. Sections 661 and 662 of casing 660 are ruptured when the end of cable 22 in inserted into connector 620, releasing, mixing, and preferably expanding, the two chemical components that were stored therein, and forming a continuous 360 degree seal between the cable jacket and inner wall 654 of body 646. Ridges 643, 645 and 647 are then radially deformed inward with a hex crimp tool in a known manner. The result is a connection having a high pull-out strength and good moisture sealing qualities. As an alternative to reliance upon insertion of the end of coaxial cable 22 (see FIG. 2) to rupture sections 661 and 662 of casing 600, it is also possible to insert the end of coaxial cable 22 into connector 620 without necessarily rupturing sections 661 and 662; connector 620 is then crimped with the above-mentioned hex crimp tool to radially deform ridges 643, 645 and 647 inwardly, while simultaneously rupturing sections 661 and 662 of casing 600 during such crimping process via the increased pressure exerted upon casing 600 during such mechanical deformation.

Figure 13:
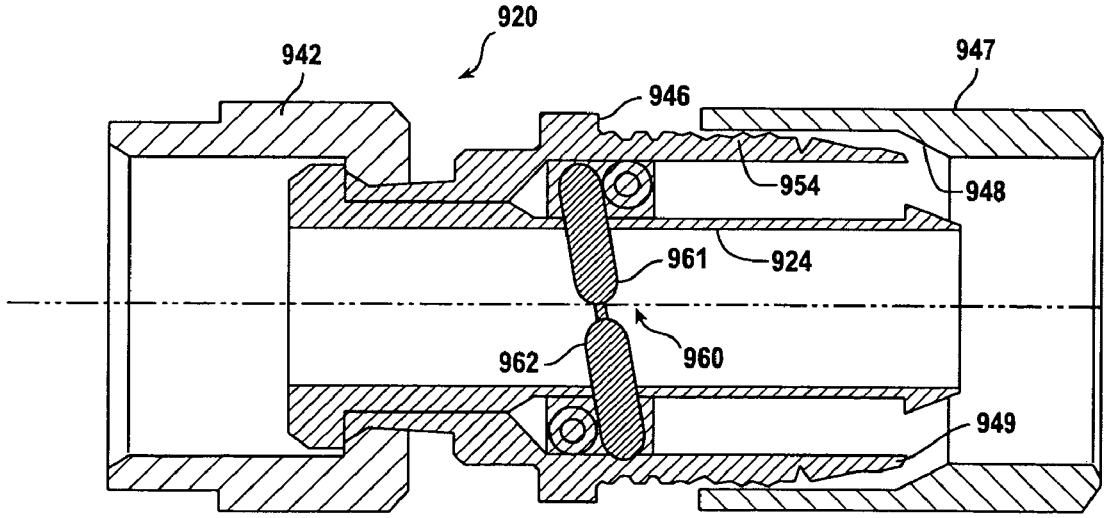
FIG. 13 illustrates a preferred embodiment of the present invention in the form of an axial-compression-style F-connector.

Referring to FIG. 13, an axial-compression-style F-connector 920 includes body member 946, tubular post 934, a coupler 942, and a compression ring 947. The form and function of body member 946, tubular post 934, coupler 942, and compression ring 947 may be as described in U.S. Pat. No. 5,997,350. Axial-compression-style F-connector 920 is fastened to the end of a coaxial cable using an industry-standard axial compression tool. Axial-compression-style F-connector 920 also includes a two-section "sausage-like" linked tubular casing 960, disposed spirally inside connector 920 between the inner wall 954 of body 946 and tubular post 934 for containing a two-component chemical sealant. Casing 960 is preferably positionable within the annulus formed between tubular post 934 and inner wall 954 of body 946. Casing 960 is capable of being wound around the outer wall of tubular post 934. As in the case of the other examples described above, it is preferred that such two-component chemical sealant be of the volume-expanding type described above to fill any gaps and form a continuous 360 degree seal between connector 920 and the outer protective jacket of a coaxial cable inserted therein. Casing 960 is divided into two separate sections 961 and 962 forming two respective reservoirs. Sections 961 and 962 of casing 960 are ruptured when the end of cable 22 (see FIG. 2) in inserted into connector 920, releasing, mixing, and preferably expanding, the two chemical components that were stored therein, and forming a continuous 360 degree seal between the cable jacket and inner wall 954 of body 946. The connector is then inserted within an axial compression tool to advance compression ring 947 toward coupler 942. Compression ring 947 includes a tapered annular wall 948 which engages the tapered end 949 of body 946, deforming such tapered end 949 inwardly against the cable jacket; this inward deformation of tapered end 949 of body 946 further helps to retain the chemical sealant, or other chemical component(s) within connector 920. Once again, the resulting connection has a high mechanical pull-out strength, as well as good moisture sealing qualities.

Figure 11A:
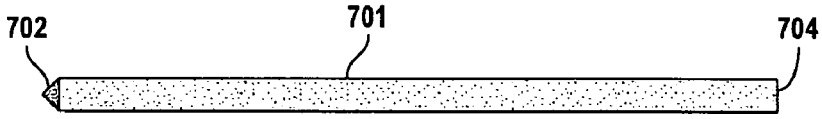
FIGS. 11A-11E illustrate a method of forming single-component chemical reservoirs useful in practicing the present invention.
Figure 11B:
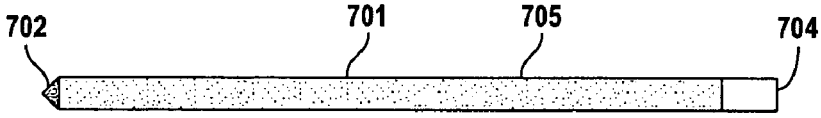
Figure 11C:
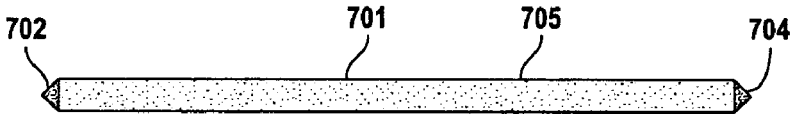
Figure 11D:
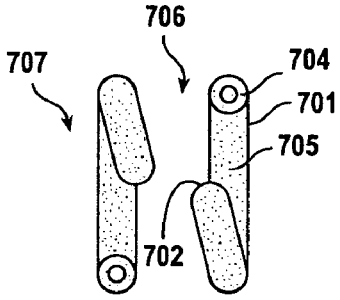
Figure 11E:
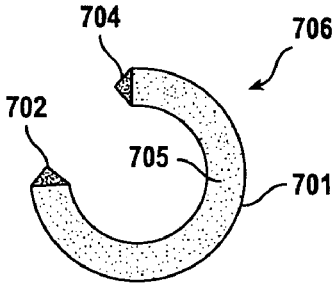

A preferred method for forming each of reservoirs 60 and 62 (see FIG. 1) is illustrated in FIGS. 11A through 11E. In FIG. 11A, an elongated section 701 of polystyrene, or other suitable packaging material, has its first end 702 sealed closed and its second end 704 open. A suitable chemical agent 705, of the types described above, is deposited within section 701 through open end 704, as shown in FIG. 11B. Second end 704 is then twisted and sealed closed, as shown in FIG. 11C. The resulting filled tubular casing structure can then be rolled to form a curved, partial ring 706, as shown in FIGS. 11D and 11E. A second such rolled casing 707 is shown in FIG. 11D for containing a second chemical agent. These rolled "sausage-like" filled casings may then be inserted into the connectors described above between their respective cylindrical sleeves and tubular posts. Each of these filled casings is positionable within the connector, and can be wound around the aforementioned tubular post of the connector. The filled casings are stackable, and as many filled casings as are necessary can be inserted into each connector.

Figure 12A:
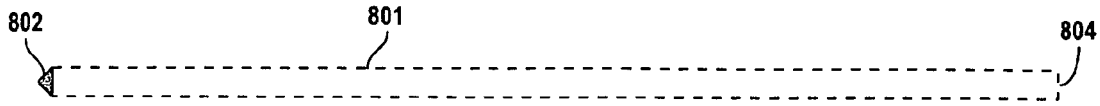
FIGS. 12A-12F illustrate a method of forming a dual-component chemical reservoir useful in practicing the present invention.
Figure 12B:
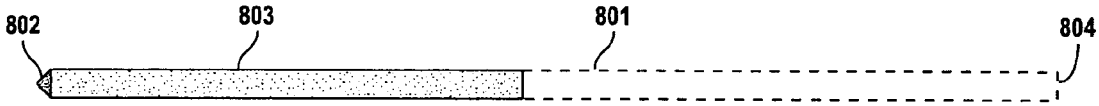
Figure 12C:
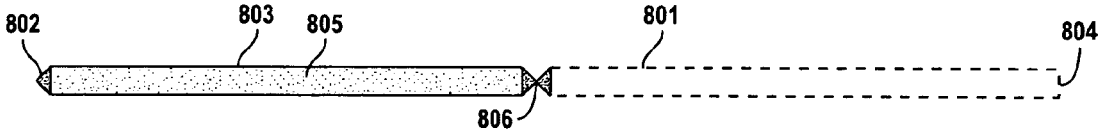
Figure 12D:
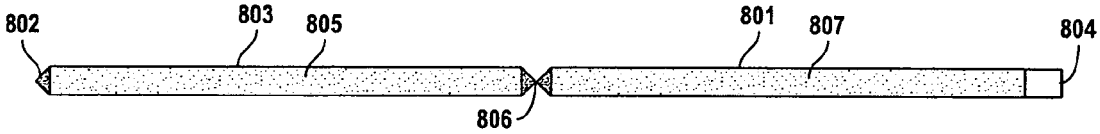
Figure 12E:
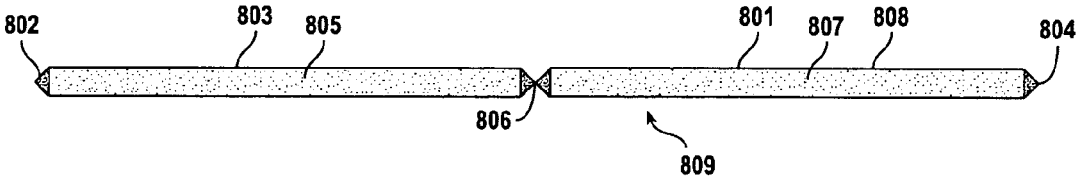
Figure 12F:
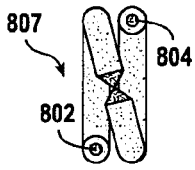

A preferred method for forming a dual-reservoir casing structure, of the type shown as item 660 in FIG. 10, is illustrated in FIGS. 12A through 12F. In FIG. 12A, an elongated section 801 of polystyrene, or other suitable packaging material, has its first end 802 sealed closed and its second end 804 open. A first suitable chemical agent 803, of the type described above, is deposited within section 801, proximate sealed end 802 thereof, through open end 804, as shown in FIG. 12B, filling approximately one-half of section 801. Section 801 is then twisted about its midpoint 806 to seal off chemical agent 803 within section 805, as indicated in FIG. 12C. Midpoint 806 can be heated and sealed closed, if desired. A second chemical agent 807 is then deposited within the remainder of section 801 through open end 804, as indicated in FIG. 12D. Second end 804 is then twisted and sealed closed, as shown in FIG. 12E, forming a second section 808 of the original tube 801. The resulting filled casing structure 809 can then be rolled to form a spiral shape dual-reservoir curved sausage-like body shown in FIG. 12F, which may then be inserted into the connectors described above between their respective cylindrical sleeves and tubular posts. In some preferred embodiments, the reservoir has at least one spatial dimension (e.g., length, width, diameter, etc.) which is greater than one-twentieth of the diameter of the coaxial cable, whereby the reservoir can be more easily positioned within the coaxial connector.

Those skilled in the art will now appreciate that an improved coaxial connector has been described which avoids the need for conventional installation tools in favor of easy hand installation. The disclosed coaxial connector fits a wide range of cable types and sizes, thereby reducing the number of connectors required to fit various cables used in the field. The disclosed chemical agents reliably bond the coaxial cable to the connector and simultaneously forms a continuous 360 degree seal between the cable jacket and the connector body to prevent moisture wicking into the interior of the connector.

While the present invention has been described with respect to preferred embodiments thereof, such description is for illustrative purposes only, and is not to be construed as limiting the scope of the invention. For example, while reservoirs 60 and 62 are shown as curving about tubular post 34, such reservoirs could also, if desired, extend axially between the tubular post and the surrounding cylindrical sleeve. As another example, the casing for containing one or more chemical components could have a non-tubular form, such as spherical, ellipsoidal, or polyhedral. Various modifications and changes may be made to the described embodiments by those skilled in the art without departing from the true spirit and scope of the invention as defined by the appended claims.

The invention claimed is:

1. A coaxial connector for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an end of the coaxial cable around the dielectric thereof and under the conductive grounding sheath thereof, said tubular post having an opposing second end;

b. a coupler engaging the second end of said tubular post, the coupler serving to secure the connector to the coaxial port;

c. a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and d. a first frangible reservoir comprised of a first casing containing a first adhesive component, the first frangible reservoir being disposed within the cylindrical body member between the tubular post and the inner wall of said cylindrical sleeve, wherein the insertion of the end of the coaxial cable into the connector releases said first adhesive component from the first casing of the first frangible reservoir for effecting an adhesive bond between the protective outer jacket of the coaxial cable and the inner wall of said cylindrical sleeve, wherein the first adhesive component is contained entirely within the casing, without directly contacting the cylindrical body or tubular post, until the first casing is ruptured, and wherein the first casing has at least one spatial dimension which is greater than one-twentieth of the diameter of the coaxial cable.

2. The coaxial connector recited by claim 1 wherein said first adhesive component is contained in microcapsules.

3. The coaxial connector of claim 1 wherein the first frangible reservoir has at least one spatial dimension which is greater than one-twentieth of the diameter of the coaxial cable.

4. The coaxial connector of claim 1 wherein the cylindrical body member further comprises an inwardly-directed flange proximate the first end of the cylindrical body member.

5. The coaxial connector of claim 1 wherein the first frangible reservoir at least partially encircles the tubular post.

6. The coaxial connector of claim 1 wherein the first frangible reservoir is disposed spirally within the cylindrical body member.

7. The coaxial connector recited by claim 1 further including a second frangible reservoir comprised of a second casing containing a second adhesive component disposed within the cylindrical body member between the tubular post and the inner wall of said cylindrical sleeve, and generally proximate to said first frangible reservoir, wherein the insertion of the end of the coaxial cable into the connector releases both said first and second adhesive components from the casings of the first and second frangible reservoirs, respectively, for effecting an adhesive bond between the protective outer jacket of the coaxial cable and the inner wall of said cylindrical sleeve.

8. The coaxial connector of claim 7 wherein the first and second frangible reservoirs are stacked within the cylindrical body member.

9. The coaxial connector of claim 7 wherein the first and second frangible reservoirs are formed from a linked tubular casing.

10. A coaxial connector for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an end of the coaxial cable around the dielectric thereof and under the conductive grounding sheath thereof, said tubular post having an opposing second end;

b. a coupler engaging the second end of said tubular post, the coupler serving to secure the connector to the coaxial port;

c. a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and d. a first frangible reservoir containing a first chemical component disposed within the cylindrical body member between the tubular post and the inner wall of said cylindrical sleeve, said first chemical component occupying a first initial volume before being released from the first frangible reservoir, wherein the insertion of the end of the coaxial cable into the connector releases said first chemical component from the first frangible reservoir, the first chemical component increasing in volume, relative to the first initial volume, upon release from the first frangible reservoir for substantially filling at least a portion of a space lying between the protective outer jacket of the coaxial cable and the inner wall of said cylindrical sleeve.

11. The coaxial connector recited by claim 10 further including a second frangible reservoir containing a second chemical component disposed within the cylindrical body member between the tubular post and the inner wall of said cylindrical sleeve, and generally proximate to said first frangible reservoir, said second chemical component occupying a second initial volume before being released from the second frangible reservoir, wherein the insertion of the prepared end of the coaxial cable into the connector releases both said first and second chemical components from the first and second frangible reservoirs, respectively, the first and second chemical components increasing in volume, relative to their respective initial volumes, upon release from their respective reservoirs for substantially filling at least a portion of the space lying between the protective outer jacket of the coaxial cable and the inner wall of said cylindrical sleeve.

12. A coaxial connector for coupling the end of a coaxial cable to a coaxial port, the coaxial cable having a center conductor surrounded by a dielectric, the dielectric being surrounded by a conductive grounding sheath, and the conductive grounding sheath being surrounded by a protective outer jacket, said connector comprising in combination:

a. a tubular post having a first end adapted to be inserted into an end of the coaxial cable around the dielectric thereof and under the conductive grounding sheath thereof, said tubular post having an opposing second end;

b. a coupler engaging the second end of said tubular post, the coupler serving to secure the connector to the coaxial port;

c. a cylindrical body member having a first end and a second end, the first end of said cylindrical body member including a cylindrical sleeve having an inner wall bounding a central bore extending about said tubular post, the second end of said cylindrical body member engaging said tubular post proximate the second end thereof, said cylindrical sleeve having an open end for receiving the end of the coaxial cable; and d. a reservoir containing a chemical component disposed within the cylindrical body member between the tubular post and the inner wall of said cylindrical sleeve, said chemical component reacting with the protective outer jacket of the coaxial cable upon contact therewith for causing swelling of said protective outer jacket, wherein the insertion of the end of the coaxial cable into the connector releases said chemical component from the reservoir for making contact with the outer protective jacket of the coaxial cable, and for causing the outer protective jacket to swell within, and substantially fill, at least a portion of a space lying between the conductive grounding sheath of the coaxial cable and the inner wall of said cylindrical sleeve.

13. The coaxial connector recited by claim 12 wherein said chemical component is in the form of microcapsules.

14. A method of securing an end of a coaxial cable within a coaxial connector, the coaxial cable including a center conductor surrounded by a dielectric, a conductive grounding sheath, and an outer protective cable jacket, comprising the steps of:

a. providing a coaxial connector including a tubular post, a body having a cylindrical sleeve surrounding the tubular post and having an open end for receiving the end of the coaxial cable, and including a coupler for securing the coaxial connector to a coaxial port;

b. inserting into the coaxial connector, between the tubular post and the cylindrical sleeve, at least one chemical agent stored within a casing, said insertion step being performed before supplying such coaxial connector to an end user;

c. inserting the end of the coaxial cable into the open end of the cylindrical sleeve of the connector body, opening the casing, and releasing the at least one chemical agent to flow within the annulus formed between the tubular post and the cylindrical sleeve to secure the coaxial cable within the cylindrical sleeve of the connector, wherein the at least one chemical agent is contained entirely within the casing, without directly contacting the body or tubular post, until the casing is opened, and wherein the casing has at least one spatial dimension which is greater than one-twentieth of the diameter of the coaxial cable.

15. The method recited by claim 14 wherein the chemical agent causes the protective outer jacket of the coaxial cable to swell upon contact therewith.

16. The coaxial connector of claim 14 wherein the at least one chemical agent expands in volume, thereby compressing the cable jacket and the conductive grounding sheath against the tubular post.

17. The method recited by claim 14 wherein the chemical agent is an adhesive.

18. The method recited by claim 17 wherein the chemical agent includes two adhesive components stored in two casings, and wherein said insertion step includes the step of opening both casings as a result of inserting the end of the coaxial cable to mix the two adhesive components.

19. The method recited by claim 14 wherein the chemical agent is an expandable sealant.

20. The method recited by claim 19 wherein the chemical agent includes two expandable sealant components stored in two casings, and wherein said insertion step includes the step of opening both casings as a result of inserting the end of the coaxial cable to mix the two expandable sealant components.

21. A coaxial connector for connection to a coaxial cable, the coaxial connector comprising:

a. a cylindrical body comprising an inner wall bounding a central bore;

b. a tubular member disposed within the central bore and comprising an outer wall, wherein the outer wall and the inner wall of the cylindrical body define an annular space;

c. a rupturable body disposed within the annular space, the rupturable body containing a flowable material, wherein the flowable material is contained entirely within the rupturable body. without directly contacting the cylindrical body or tubular member, until the rupturable body is ruptured, and wherein the first frangible reservoir has at least one spatial dimension which is greater than one-twentieth of the diameter of the coaxial cable; and d. wherein the cylindrical body, the tubular member, and the rupturable body are adapted to allow the rupturable body to rupture upon insertion of the cable within the annular space and to allow the flowable material to contact the coaxial cable.

22. The coaxial connector of claim 21 wherein the cylindrical body member further comprises an inwardly-directed flange proximate the first end of the cylindrical body member.

23. The coaxial connector of claim 21 wherein the rupturable body at least partially encircles the tubular post.

24. The coaxial connector of claim 21 wherein the rupturable body is disposed spirally within the cylindrical body member.

25. The coaxial connector recited by claim 21 wherein the flowable material is a liquid.

26. The coaxial connector recited by claim 25 wherein the liquid has a first volume within the rupturable body, and wherein the liquid cures into a solid after escaping from the rupturable body, the solid having a second volume greater than said first volume.

27. The coaxial connector recited by claim 25 wherein the liquid, upon escaping from the rupturable body, causes a portion of the cable to swell.

28. The coaxial connector recited by claim 25 wherein the liquid is an adhesive.

29. The coaxial connector recited by claim 28 wherein the adhesive cures into solid form.

* * * * *